United States Patent [19]

Mattingly, Jr. et al.

[11] Patent Number: 4,500,153

[45] Date of Patent: Feb. 19, 1985

[54] SELF-LOCKING ELECTRICAL CONNECTOR

[75] Inventors: William R. Mattingly, Jr., Santa Ana, Calif.; Lyle Johnson, Ft. Lauderdale, Fla.; Tommy B. Maher, La Verne, Calif.

[73] Assignee: Matrix Science Corporation, Torrance, Calif.

[21] Appl. No.: 319,543

[22] Filed: Nov. 9, 1981

[51] Int. Cl.[3] ..... H01R 13/62

[52] U.S. Cl. ..... 339/89 M; 339/DIG. 2

[58] Field of Search ..... 339/89 R, 89 C, 89 M, 339/91 R, 90 R, 90 C, 90 F, DIG. 2

[56] References Cited

U.S. PATENT DOCUMENTS

| | | | |
|---|---|---|---|
| 3,165,340 | 1/1965 | Kuehl et al. | 339/89 M |
| 3,513,436 | 5/1970 | Nodfelt | 339/DIG. 2 |
| 3,546,658 | 12/1970 | Van Norssen et al. | 339/91 R |
| 3,552,777 | 1/1971 | Heinrich et al. | 339/89 R |
| 3,601,764 | 8/1971 | Cameron | 339/DIG. 2 |
| 3,669,472 | 6/1972 | Nadsady | 339/89 R |
| 3,808,580 | 4/1974 | Johnson | 339/91 R |
| 3,947,081 | 3/1976 | Peterson | 339/DIG. 2 |
| 4,030,798 | 6/1977 | Paoli | 339/89 R |
| 4,165,911 | 8/1979 | Laudig | 339/89 C |
| 4,290,662 | 9/1981 | Storcel | 339/DIG. 2 |

FOREIGN PATENT DOCUMENTS

| | | | |
|---|---|---|---|
| 1157282 | 11/1963 | Fed. Rep. of Germany | 339/89 M |

*Primary Examiner*—Gil Weidenfeld

*Assistant Examiner*—Gary F. Paumen

*Attorney, Agent, or Firm*—Nilsson, Robbins, Dalgarn, Berliner, Carson & Wurst

[57] ABSTRACT

A self locking electrical connector assembly includes a connector shell and a coupling nut. The connector shell has a centrally located outwardly projecting annular flange with a plurality of retaining shoulders by which the coupling nut is mounted to the connector shell and allowed to rotate but prevented from substantial axial movement. The coupling nut cavity is defined by a front annular retention shoulder, a back access opening opposite the front retention shoulder, a cylindrical surface between the front shoulder and the access opening, an annular retention groove in the cylindrical surface adjacent the access opening and an annular back facing stop shoulder between the retention groove and the front shoulder. A retaining ring held in the retention groove abuts against a back facing shoulder of the shell's annular flange. A front facing stop shoulder of the annular flange abuts against the back facing stop shoulder of the coupling nut. A front facing shell abutment shoulder abuts against the end of a mating shell. A wave spring is positioned in the cavity between the front retention shoulder and the annular flange to press a plurality of dimples in a clutch plate into the plurality of grooves in a front facing ratchet surface located about the annular flange to hinder loosening rotation of the coupling nut.

11 Claims, 5 Drawing Figures

SELF-LOCKING ELECTRICAL CONNECTOR

BACKGROUND OF THE INVENTION

The present invention relates to electrical connectors and in particular to self-locking connector assemblies.

Self-locking electrical connectors are presently used in a multitude of industries and in particular in the aircraft industry as an alternative to safety wire connector locking. A number of self-locking electrical connector assemblies which do not require safety wire have been devised. Illustrative of such connector assemblies is the connector assembly shown in Johnson U.S. Pat. No. 3,808,580 which incorporates an annular surface with a plurality of grooves against which is pressed a clutch plate with a plurality of dimples extending therefrom. The clutch plate is pressed against the engagement surface utilizing a wave spring. The entire assembly is held in place with a retaining ring positioned in a cavity between the coupling nut and the shell of the connector.

While the above-described arrangement and others similar to it provide suitable self-locking coupling connector assemblies in many applications, it has been found that connector failures have occurred in high vibration environments after extended periods of time. These failures have been a result of several different factors. For example, in some connector assemblies, the wave spring presses against the back of a clutch plate which engages an annular engagement surface of a flange extending from the outside surface of the connector shell. As the nut is tightened onto the mating shell, the wave spring presses against the back of the clutch plate to press the clutch plate against the engagement surface to prevent rotation of the nut. Such devices rely on the continued resiliency of the wave spring to keep the clutch plate pressed against the engagement surface. However, because of the configuration and the placement of the wave spring, tightening of the nut caused axial deformation of the wave spring to a point that creates a permanent deformation resulting in a decrease in the resiliency in the spring. After multiple couplings and uncouplings of the connector assembly the wave spring becomes deformed to an extent that it cannot hold the clutch plate against the engagement surface with sufficient force to prevent rotation of the coupling nut relative to the connector shell in the high vibration environment.

Another problem which existed in some connector assemblies was the dislodgment of the retention ring which holds the coupling nut to the connector shell and retains the wave spring and clutch plate in place. Specifically, it was found that occasionally in high vibration environments the retaining ring would become dislodged from its retaining groove in the coupling nut thereby removing the back surface against which the wave spring pressed. This prevented the wave spring from pressing the clutch plate against the engagement surface. The result was a breaking of connector seals and shorting between various pin connectors due to conductive contaminations.

In order to solve the above-described problems and to provide a connector assembly wherein the wave spring applies a continuous, substantially constant force against the back of a clutch plate, the present invention provides a means of keeping a retention ring in the retention groove without becoming dislodged by vibration, and by providing a structure which limits axial movement of the coupling nut relative to the shell on which the coupling nut is mounted so that the wave spring is never compressed to a degree that will cause permanent deformation and hence a loss of resiliency.

In addition, the present invention provides an improved engagement mechanism between the clutch plate and the engagement surface whereby the engagement surface includes a ratchet face with a plurality of ratchet-like grooves which extend at a steep angle from the engagement surface on one side and at a shallow angle from the engagement surface on the other side so that the coupling nut can be more easily rotated to couple the connector shell to the mating shell than to decouple the connector shell from the mating shell.

Such an engagement mechanism prevents loosening of the coupling nut in a high vibration environment since it requires not only that the dimples in the clutch plate be moved against the force being applied by the wave spring but also requires that the coupling nut be simultaneously rotated. Furthermore, because of the multiple dimples and ratchet grooves about the entire circumference of the engagement and clutch plate surfaces, the entire clutch plate would have to move axially to effect disengagement. It would be insufficient for the clutch plate to twist slightly so that for example, only the dimples on one side of the clutch plate would become dislodged from the ratchet gooves.

The present invention also utilizes a plurality of shoulders which prevent the axial width of the space between the coupling nut and the shell in which the wave spring and clutch plate are retained to vary by more than a predefined amount. Therefore, the wave spring will retain its resiliency regardless of how much the coupling nut is tightened on the mating shell.

SUMMARY OF THE INVENTION

A self-locking electrical connector assembly with improved wave spring mounting comprises a cylindrical first shell, a cylindrical second shell, and a coupling nut mounted to the second shell. The first shell may either be a or pin mounting shell or may be a pin receptacle shell. The first shell is provided with an annular abutment surface at one of its ends. The second shell includes an annular bottoming shoulder which faces in a first direction for abutment against the abutment surface of the first shell and a nut retention flange which extends radially from the outer surface of the second shell at a central location therealong. The nut retention flange has an annular engagement surface facing in the first axial direction and an annular flange retention shoulder facing in a second direction opposite the first direction. The coupling nut has a cylindrical interior surface defining a bore. One side of the annular grove defines an annular groove retention shoulder which faces in the first direction. An annular groove is provided about the interior surface. One side of the annular groove defines an annular groove retention shoulder which faces in the first direction. The coupling nut further has an annular spring retention shoulder which extends radially into the bore facing in the second direction. A retention ring is positioned in the groove for abutting against the groove retention shoulder on one of its sides and against the flange retention shoulder on the other of its sides for attaching the coupling nut to the second shell and thereby limiting axial movement of the coupling nut relative to the second shell in the first direction. An annular clutch plate which is fixed to be rotatable with the coupling nut is positioned to press against and engage the engagement surface. A wave spring is positioned between the spring retention shoulder and the clutch plate for pressing the clutch plate into rotation hindering engagement with the engagement surface where the axial distance between the spring retention shoulder and the engagement surface is greater than a preselected minimum distance when the abutment surface of the first shell abuts against the bottom shoulder of the second shell and the retention ring is axially between and abuts against both the groove retention shoulder and the flange retention shoulder. Axial movement of the coupling nut relative to the first and second shells in the first direction is thereby prevented. The minimum distance is selected for preventing the wave spring from being axially compressed more than a predetermined amount when the first shell is interconnected to the second shell by the coupling nut.

In accordance with one aspect of the invention, the connector assembly further includes an axially disposed anti-walkout shoulder extending perpendicular to the flange retention shoulder and positioned in facing relationship to the interior edge of the retention ring whereby radial movement of the retention ring from its position in the annular groove in the coupling nut is prevented.

Still another feature of the present invention is an annular first step shoulder which is disposed about the periphery of the nut retention flange and an annular second stop shoulder which extends radially from the interior surface into the bore of the coupling nut. The first and second stop shoulders are then positioned and aligned in axially facing relationship for abutting against each other to prevent relative axial movement between the second shell and the coupling nut when the coupling nut is moved to disconnect the first and second shells from each other.

In accordance with the invention, the engagement surface preferably comprises a ratchet face and the clutch plate has a plurality of dimples extending therefrom for engagement with the ratchet face. The ratchet face is provided with a plurality of annularly disposed dimple engaging grooves for enabling relatively easier rotation of the coupling nut to connect the second shell to the first shell then rotation of the coupling nut to disconnect the first shell from the second shell.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

Figure 1:
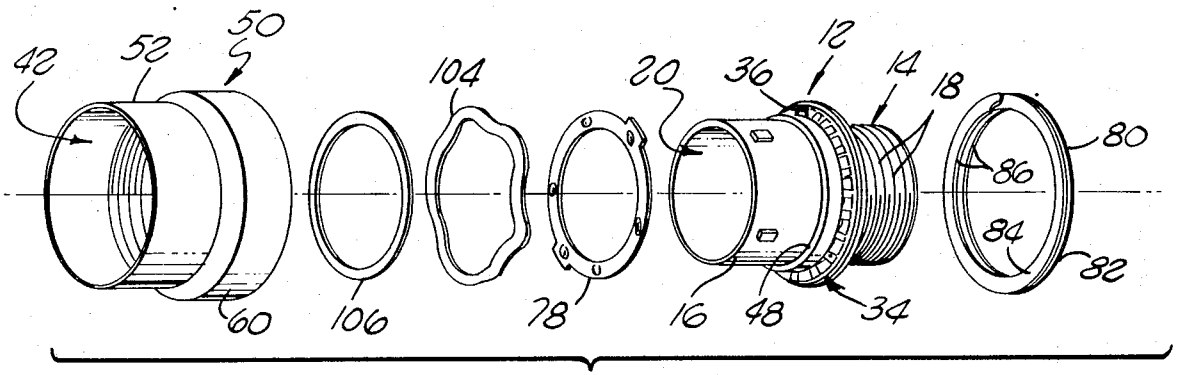
FIG. 1 is an exploded perspective view of an electrical connector shell and self-locking coupling nut made in accordance with the invention.
Figure 2:
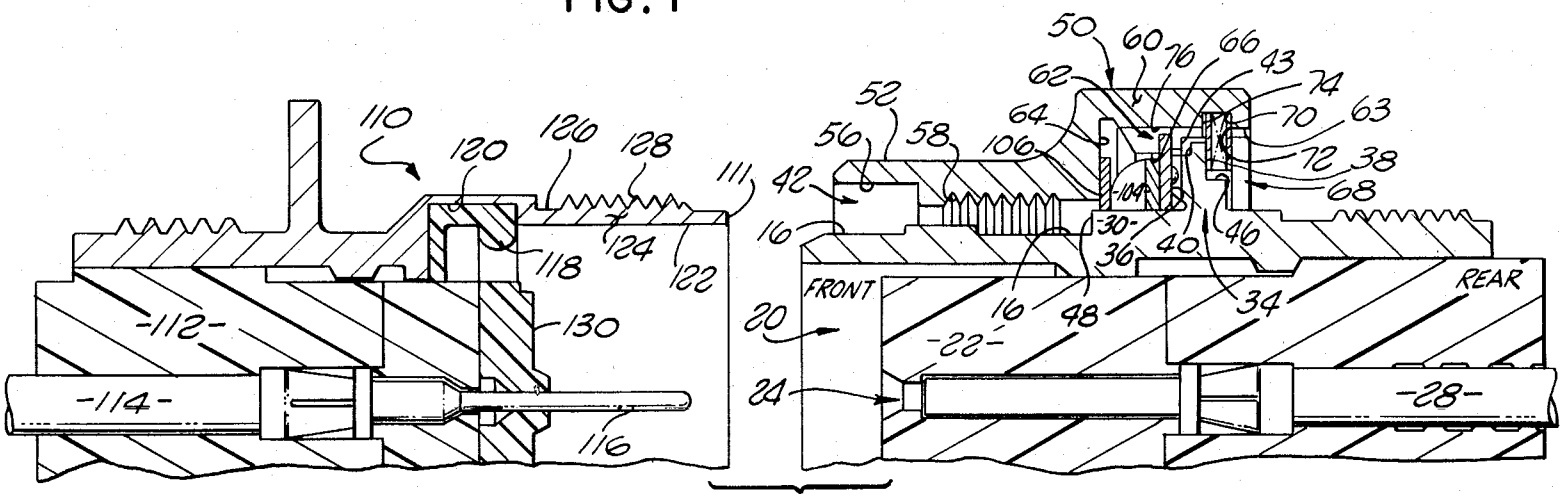
FIG. 2 is a side view, in section, of a pair of mating electrical connectors, on one of which is mounted the self-locking nut of FIG. 1.
Figure 3:
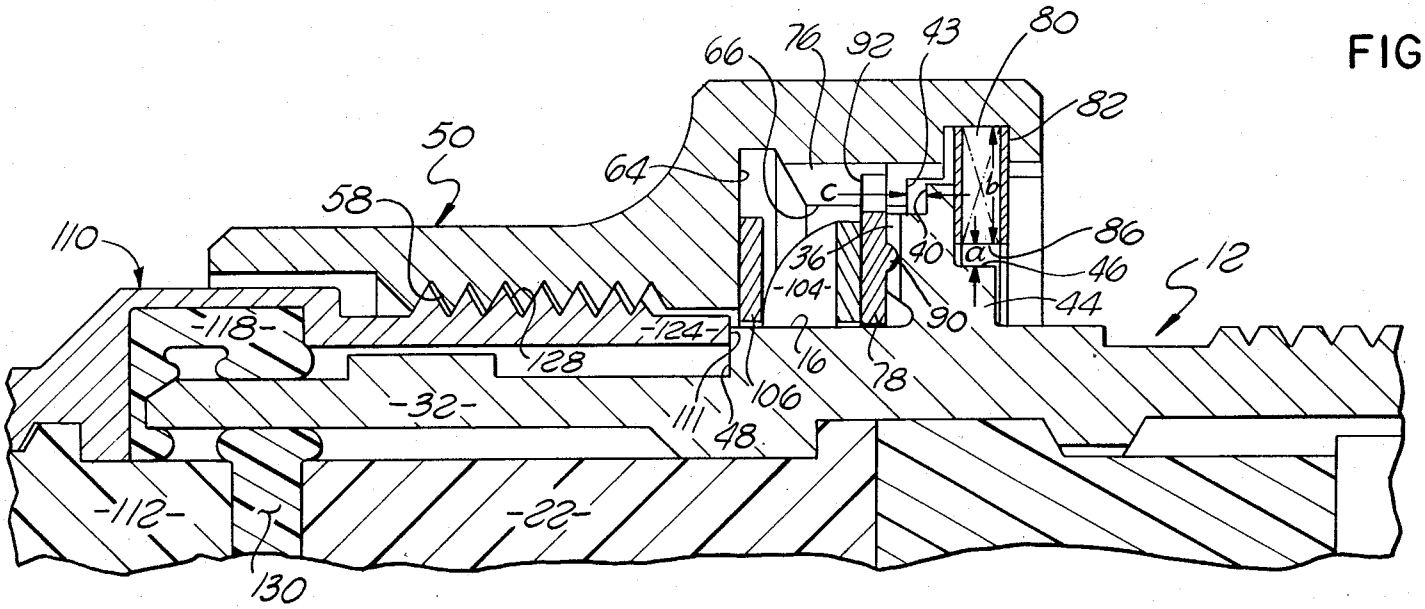
FIG. 3 is a side view, in section, of the electrical connector of FIG. 2 in a fully mated condition.

Referring to FIGS. 1, 2 and 3, a connector assembly in accordance with the invention includes a shell 12, a shell 110, and self-locking coupling nut 50. The connector shell 12 comprises a generally cylindrical rear portion 14 having an outer surface 16 with threads 18 positioned thereabout for interconnecting the shell 12 to a bulkhead, terminal structure or other suitable mounting device. The connector shell 12 has a centrally disposed bore 20 therethrough for receiving and holding an insulator insert 22, having one or more conductor receiving bores 24 therethrough. Suitable socket or pin contacts such as socket contact 26 attached to the end of a conductor 28 are then inserted into the conductor receiving bore 24 in a conventional manner.

The connector shell 12 includes a central portion 30 and a front portion 32. An annular nut retention flange 34 extends radially outwardly from the outer surface 16 of the shell 12. The nut retention flange 34 has a front facing engagement surface 36 on one of its sides and a rear facing flange retention shoulder 38 on its other side with a front facing annular stop shoulder 40 disposed about the periphery of the nut retention flange 34. The stop shoulder 40 is positioned axially rearwardly of the engagement surface 36. Of course, it will be appreciated that the axial position of the first stop shoulder 40 may be at any forward or rearward axial location relative to the engagement surface 36 without departing from the spirit of the invention. Finally, the nut retention flange 34 has a rear facing extension portion 44 defining an annular antiwalkout shoulder 46 which extends generally perpendicular to the rear facing flange retention shoulder 38.

A front facing annular bottoming shoulder 48 is disposed on the outer surface 16 between the front portion 32 and the central portion 30 of the shell 12.

The coupling nut 50 in accordance with the invention has a front cylindrical portion 52 having a central bore 42 therethrough defined by an interior surface 56 having an interior thread 58 therealong for interconnecting to a suitable mating shell to be described hereafter. The coupling nut 50 further has a rear cylindrical portion 60 surrounding a generally cylindrical cavity 62 bounded on its frontmost side by a spring retention shoulder 64 which extends between the rearmost edge of the interior surface 56 and the frontmost edge of a cylindrical interior surface 66 defining the radial bounds of the cavity region 62. The cavity region 62 is bounded at its rearmost point by an opening 63. Thus, the cavity region 62 comprises a bore 68 extending into the rear cylindrical portion 60 of the coupling nut 50 where the bore 68 has a larger diameter than the bore 42.

An annular groove 70 is then provided to extend into the interior surface 66 in the cavity region 62 to define a front facing, annular groove retention shoulder 72 on one of its sides and a rear facing retention shoulder 74 on its other side. A key slot 76 is cut axially into the interior surface 66 to provide a means of interconnecting a clutch plate 78 to the coupling nut 50 to rotate therewith.

In accordance with the invention the coupling nut 50 is interconnected to the shell 12 utilizing a retention ring 80 which is positioned to be held in the groove 70 so that the outer edge region of one side 82 of the retention ring 80 abuts against the groove retention shoulder 72 and the inner edge region of the other side 84 of the retention ring 80 abuts against the flange retention shoulder 38. An annular interior edge 86 between the two sides 82 and 84 of the retention ring 80 is then in position facing the antiwalkout shoulder 46 and spaced a distance "a" therefrom where the distance "a" is sufficiently small that the retention ring 80 is prevented from radial movement out of the groove 70 at any location about its periphery by the antiwalkout shoulder 46.

The antiwalkout shoulder 46 is particularly important when the electrical connector assembly is utilized in a high vibration environment. Such an environment results in movement between the retention ring 80 and the coupling nut 50 which, if severe enough, will cause the retaining ring 80 to move radially inwardly and become dislodged from the annular groove 70. By placing the antiwalkout shoulder 46 adjacent the annular interior edge 86 of the retention ring 80, the amount of radial movement of the retention ring 80 is limited thereby preventing the retention ring 80 from becoming disloged from the groove 70. At the same time, the radial width "b" of the retention ring 80 is sufficiently small so that it can be inserted through the opening 63 in a conventional manner. It will, of course, be appreciated that the retention ring 80 is a ring having two end regions which overlap so that the maximum diameter of the ring can be decreased by the application of radial pressure to increase the overlap region and thereby allow insertion into the groove. When the radial compression force is released the ring returns to its original diameter.

In accordance with the invention, the clutch plate 78 is positioned in the cavity region 62 between the outer surface 16 of the shell 12 and the interior surface 66 of the coupling nut 50. The clutch plate 78 is a washer-like member with a plurality of dimples 90 extending from selected angular locations about the rear facing surface of the clutch plate 78. A generally rectangular key flange 92 extends from one region about the periphery of the clutch plate 78 for being positioned in the key slot 76 to thereby prevent rotation of the clutch plate 78 relative to the coupling nut 50 and to assure that the clutch plate 78 and the coupling nut 50 rotate together relative to the shell 12.

Figure 5:
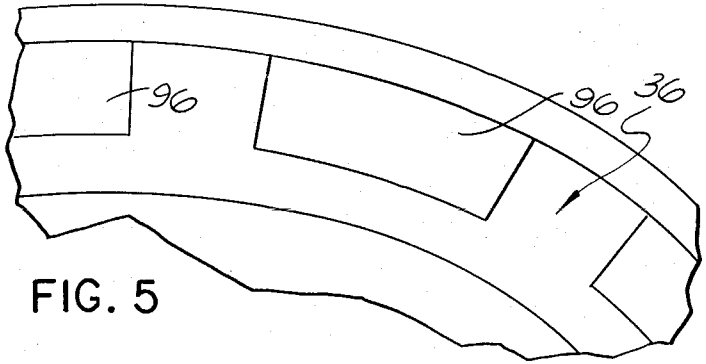
FIG. 5 is a partial top view of the ratchet face in accordance with the invention.
Figure 4:
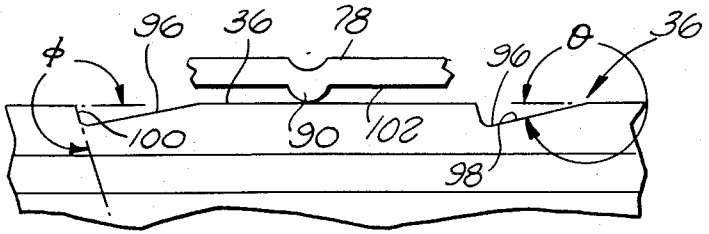
FIG. 4 is a cross-sectional side view of a section of the ratchet surface and clutch plate in accordance with the invention.

Referring to FIGS. 4 and 5, the engagement surface comprises an annular ratchet surface (face) 36 with a plurality of dimple engaging grooves 96 extending into the ratchet surface 36. In one embodiment, the dimple engaging grooves 96 are positioned every 30 degrees about the periphery of the ratchet surface 36 where each dimple engaging 96 groove comprises a pair of slanted surfaces 98 and 100. In one embodiment, a first slanted surface 98 extends from the ratchet surface 36 at an angle $\theta$ of 10 degrees while the second surface 100 slants into the ratchet surface 36 at an angle $\theta$ of 80 degrees. The slanted surfaces 98 and 100 of each dimple engaging groove 96 are oriented so that the clutch plate 78 will rotate easily when the coupling nut 50 is tightened onto the mating shell 110 because each dimple 90 in the clutch plate 78 will be moving upward along the 10 degree inclined first surface 98 and down over the 80 degree inclined second surface 100. On the other hand, when the coupling nut 50, and hence the clutch plate 78, is rotated in the opposite direction to uncouple the connector shell 12 from the mating shell 110, the dimples 90 will move down the 10 degree inclined first surface 98 but will have to move up the 80 degree incline second surface 100 which requires substantially greater force. Hence, it is substantially easier to tighten the coupling nut 50 onto a suitable receptacle shell 110 than it is to decouple the connector shell 12 from the mating shell 110.

In one embodiment, the depth of each groove is 0.012 inch with the heighth of each dimple being 0.012 inch or less so that when the dimple is in place in the groove, the bottom face 102 of the clutch plate 78 will be in contact with the major portion of the surface 36.

Returning to FIGS. 1, 2 and 3, a wave spring 104 of any suitable configuration is positioned between the spring retention shoulder 64 and the back of the clutch plate 78 to urge the clutch plate against the engagement surface 36. A friction washer 106 may be positioned between the wave spring 104 and the spring retention shoulder 64 to facilitate pressing by the wave spring 104 against the clutch plate 78.

In accordance with the invention, the axial space in the cavity region between the spring retention shoulder 64 and the engagement surface 36 is selected to accommodate the clutch plate 78, the wave spring 104 and optionally the friction washer 106 so that the wave spring will always be in a non-permanent, resiliently compressed state to enable it to continuously apply a force against the back of the clutch plate 78. Such an arrangement may be assured by suitably positioning the groove retention shoulder 72, the flange retention shoulder 38, the engagement surface 36 and the spring retention shoulder 64 so that the space between the groove retention shoulder 72 and the flange retention shoulder 38 is substantially equal to the axial width of the retention ring 80. The retention ring 80 is an arrangement according to the invention, will prevent the coupling nut 50 from moving axially forward relative to the shell 12 beyond an amount wherein a predefined spacing between the spring retention shoulder 64 and the engagement surface 36 will be maintained to prevent the wave spring from being compressed beyond its resilient capabilities while at the same time allowing the wave spring to continually apply a force against the rear of the clutch plate 78.

The connector shell 12 and coupling nut 50 are adapted to interconnect to the mating shell 110 as illustrated in FIGS. 2 and 3. The mating shell 110 is a generally cylindrical member with a central bore therein for receiving an insulator plug 112 with a plurality of conductors 114 with pin or socket contacts such as the pin contact 116 fixed to the end of the conductors 114 and mounted in the insulator 112. The pin contacts 116 protrude from the end of the insulator 112 and are oriented to align with the socket contacts 26 in the insulator 22 in the center bore 20 of the connector shell 12. A deformable seal 118 is positioned in an annular retaining groove 120 in the interior surface 122 of the shell engaging end 124 of the mating shell 110. The outer surface 126 of the connector shell engagement end 124 has external threads 128 for mating with the internal threads 58 in the front cylindrical portion 52 of the coupling nut 50. Another seal 130 is disposed to cover the end of the insulator 112.

Referring to FIG. 3, the front portion 32 of the shell 12 is inserted into the interior bore of the connector shell engagement end 124 of the mating shell 110 so that the front end portion 32 of the shell 12 presses against the seal 118 to provide a circumferential seal between the mating shell 110 and the connector shell 12. At the same, time the front face of the insulator insert 22 presses against the seal 130 with each pin contact 116 being inserted into and making electrical contact with a corresponding socket contact 26 in the insulator insert 22. The seal 130 provides a moistureproof seal between the opposing front faces of the insulator insert 22 and the insulator insert 112. The coupling nut 50 is then screwed onto the outer surface of the connector shell engagement end 124 to thereby engage the internal thread 58 with the external thread 128.

The coupling nut 50 is rotated to pull the connector shell 12 to the mating shell 110 until the abutment end 111 of the mating shell 110 abuts against the bottoming shoulder 48 of the connector shell 12. In that orientation, the wave spring 104 presses the clutch plate 78 against the engagement surface 36 to maintain the dimples 90 in the dimple engagement grooves of the ratchet face 94 of the engagement surface 36. This self-locking mechanism prevents the coupling nut 50 from rotating to loosen the coupling between the connector shell 12 and the mating shell 110 under vibrational effects since all of the plurality of dimples would have to be simultaneously displaced in an axial direction by an amount sufficient to lift the dimples out of the plurality of dimple engaging grooves and then simultaneously effect a rotation of the coupling nut 50. Furthermore, because there is a plurality of dimples and a plurality of dimple engaging grooves about the periphery of the ratchet face and clutch plate, the simultaneous axial and rotational motion to cause loosening would have to occur a number of times to affect a total revolution of the coupling nut 50. In addition, the dimples would be required to move up the 80 degree angled face of the grooves which is considerably more difficult than moving up the 10 degree sloped face of the dimple retention grooves required when the coupling nut is tightened.

When the coupling nut 50 is rotated to disconnect the connector shell 12 from the receptacle shell 110 it will be appreciated that the seals 118 and 130 between the connector shell 12 and the mating shell 110 and the physical contact between the pins 116 and the sockets 26 will cause the connector shell 12 and the mating shell 110 to remain together as the coupling nut 50 is rotated. Such an action will cause the spring retention shoulder 64 to move toward the engagement surface 36 thereby causing the wave spring 104 to be crushed beyond its resilient capabilities. To prevent such wave spring crushing and to further provide a mechanism for automatically separating the connector shell 12 from the mating shell 110 and breaking the seals 118 and 130, the present invention further provides a corner groove region between the retention shoulder 74 and the interior surface 66 to define a second annular stop shoulder 43 which is positioned axially opposite to the first stop shoulder 40 with a tolerance space "c" therebetween when the coupling nut 50 is tightened to a maximum extent to hold the connector shell 12 and the mating shell 110 together.

As the coupling nut 50 is loosened, the second stop shoulder 43 will move toward the first stop shoulder 40 if the connector shell 12 is held by the seals 118 and 130 to the mating shell until the first stop shoulder 40 and the second stop shoulder 43 abut against one another. Thereafter, further loosening rotation of the coupling nut 50 will cause a force to be applied against the first stop shoulder 40 by the second stop shoulder 43 to disengage the connector shell 12 from the mating shell 110.

While the above detailed description has been made with respect to the preferred embodiments illustrated in the FIGURES, it will be appreciated that various changes and alterations in the specific configuration may be made without departing from this invention in its broader aspects. Therefore, it is the object of the claims to encompass all such modifications and changes as are within the true scope and spirit of the invention.

What is claimed is:

1. An electrical connector assembly comprising:

a cylindrical first shell having an annular abutment surface at one of its ends;

a cylindrical second shell having an annular bottoming shoulder facing in a first axial direction for abutment against the abutment surface of the first shell, an annular, radially extending, nut retention flange having an annular engagement surface facing in the first direction and an annular flange retention shoulder facing in a second direction opposite the first direction;

a coupling nut rotatably mounted on second shell for coupling the first and second shells together having:

a cylindrical interior surface defining a bore in the coupling nut, the interior surface having an annular groove therein defining an annular groove retention shoulder which faces in the first direction, and an annular spring retention shoulder extending radially into the bore and facing in the second direction;

a retention ring having oppositely facing annular sides, the ring positioned in the groove for abutting against the groove retention shoulder on one of its sides and against the flange retention shoulder on the other of its sides for attaching the coupling nut to the second shell so as to limit axial movement of the coupling nut relative to the second shell in the first direction, an annular clutch plate rotatable with the coupling nut and positioned adjacent to the engagement surface for engagement therewith; and a wave spring positioned between the spring retention shoulder and the clutch plate for pressing the clutch plate into rotation hindering engagement with the engagement surface, the axial distance between the spring retention shoulder and the engagement surface being greater than a minimum distance when the abutment surface of the first shell abuts against the bottoming shoulder of the second shell and the retention ring is axially between and abuts against both the groove retention shoulder and the flange retention shoulder, the minimum distance being selected for preventing the wave spring from being axially compressed more than a predetermined amount when the first shell is interconnected to the second shell by the coupling nut.

2. The electrical connector assembly of claim 1 wherein the retention ring has an annular interior edge and the connector assembly further comprises an axially disposed antiwalkout shoulder extending from and perpendicular to the flange retention shoulder and positioned in facing relationship to the interior edge of the retention ring for limiting radial movement of the retention ring from its position in the annular groove in the coupling nut.

3. The electrical connector assembly of claim 1 or 2 further comprising:

an annular first stop shoulder disposed about the periphery of the nut retention flange for facing in the first axial direction, and an annular second stop shoulder extending from the interior surface into the bore of the coupling nut, the second stop shoulder oriented for facing in the second direction, the first and second stop shoulders being aligned in axially facing relationship for abutting against each other to prevent relative axial movement between the second shell and the coupling nut when the coupling nut is moved to disconnect the first and second shells from each other.

4. The electrical connector of claims 1 or 2 wherein the engagement surface comprises a ratchet face and the clutch plate has a plurality of dimples extending therefrom for engagement with the ratchet face, the ratchet face having a plurality of annularly disposed dimple engaging grooves for enabling relatively easier rotation of the coupling nut to connect the second shell to the first shell than rotation of the coupling nut to disconnect the first shell from the second shell.

5. The electrical connector of claim 3 wherein the engagement surface comprises a ratchet face and the clutch plate has a plurality of dimples extending therefrom for engagement with the ratchet face, the ratchet face having a plurality of annularly disposed dimple engaging grooves for enabling relatively easier rotation of the coupling nut to connect the second shell to the first shell than rotation of the coupling nut to disconnect the first shell from the second shell.

6. An electrical connector assembly for being interconnected to a first shell comprising:

a cylindrical second shell having a cylindrical outer surface and an annular nut retention flange extending outwardly therefrom, the nut retention flange having an annular first stop shoulder disposed about its periphery on one side for facing in a first axial direction and a flange retention shoulder positioned on another side, opposite the one side, for facing in a second axial direction opposite the first axial direction;

a coupling nut rotatably mounted to the second shell about its outer surface, the coupling nut having an interior surface with an annular groove therein defining an annular groove retention shoulder which faces in the first direction, the interior surface of the coupling nut further having an annular radially extending spring retention shoulder facing in the second axial direction, the annular groove being bounded on one of its sides by a radially extending annular second stop shoulder integral with the coupling nut and facing in the second axial direction;

a retention ring positioned for abutting against the groove retention shoulder on one of its sides and against the flange retention shoulder on the other of its sides; and a wave spring positioned between the spring retention shoulder and the nut retention flange, the first and second stop shoulders aligned in axially facing relationship for abutting each other to prevent relative axial movement between the second shell and the coupling nut when the coupling nut is moved to decouple the first and second shells from each other for limiting the amount of compression of the wave spring during said decoupling.

7. A self-locking electrical connector assembly comprising:

a connector shell having an outer surface and an annular shell flange extending radially outwardly from the outer surface comprising:

an annular radially projecting engagement shoulder facing in a first axial direction, an annular radially projecting first stop shoulder facing in the first axial direction, an annular radially projecting flange retention shoulder facing in a second axial direction opposite the first axial direction; and a cylindrical exterior surface extending axially from the engagement shoulder in the first direction;

a coupling nut having an access opening thereinto comprising:

an annular interior spring retention shoulder facing in the second direction, a cylindrical interior surface between the retention shoulder and the access opening, an annular second stop shoulder extending radially inwardly from the interior surface, and an annular groove in the interior surface between the access opening and the second stop shoulder, the second stop shoulder aligned in axially facing relationship to the first stop shoulder for preventing relative axial movement between the connector shell and coupling nut in one direction, the interior surface facing but spaced from the exterior surface for defining a cylindrical cavity therebetween bounded on one end by the engagement shoulder and on the other end by the spring retention shoulder;

a retention ring positioned in the annular groove for abutting against the flange retention shoulder for preventing relative axial movement between the connector shell and the coupling nut in another direction opposite the one direction; and a clutch plate interconnected to rotate with the coupling nut and positioned in the cylindrical cavity in engaging relationship to the engagement shoulder and a wave spring positioned in the cylindrical cavity to press the clutch plate into engaging relationship with the engagement shoulder.

8. The self-locking connector assembly of claim 7 further comprising a friction washer positioned in the cylindrical cavity between the wave spring and the spring retention shoulder.

9. The self-locking connector assembly of claims 7 or 8 wherein the clutch plate has a plurality of dimples extending therefrom and the engagement shoulder comprises an annular ratchet face with a plurality of ratchet grooves therein for engaging the dimples on the clutch plate for enabling relatively easier rotation of the coupling nut about the connector shell in one direction than in the other direction.

10. An electrical connector assembly for being interconnected to a first shell, comprising:

a cylindrical second shell having an annular, radially extending, nut retention flange having an annular ratchet face facing in a first axial direction;

an annular flange retention shoulder on the nut retention flange facing in the second axial direction and an annular antiwalkout shoulder extending generally perpendicularly to the flange retention shoulder;

a coupling nut rotatably mounted on the second shell, the coupling nut having a cylindrical interior surface with an annular coupling nut groove therein, and further having an annular spring retention shoulder facing in a second axial direction opposite to the first direction;

means for interconnecting the coupling nut to the second shell for limiting axial movement of the coupling nut relative to the second shell comprising a retention ring positioned in the coupling nut groove with one of its sides abutting the flange retention shoulder for attaching the coupling nut to the second shell to limit axial movement of the coupling nut relative to the second shell in at least one of the first and second axial directions, the retention ring having an annular interior edge, the antiwalkout shoulder being positioned in facing relationship to the interior edge of the retention ring for limiting radial movement of the retention ring from the retention groove;

an annular clutch plate having a plurality of dimples extending therefrom for engagement with the ratchet face of the second shell, the clutch plate interconnected to the coupling nut for being rotationally movable therewith; and, a wave spring positioned between the spring retention shoulder and the clutch plate for pressing the clutch plate into rotation hindering engagement with the ratchet face, the ratchet face having a plurality of annularly disposed dimple engaging grooves therein for enabling relatively easier rotation of the coupling nut to connect the second shell to the first shell than rotation of the coupling nut to disconnect the first shell from the second shell.

11. The connector assembly of claim 10 wherein the coupling nut has a cylindrical inner surface, the connector assembly further comprising:

an annular first stop shoulder disposed about the periphery of the nut retention flange for facing in the first axial direction, an annular second stop shoulder extending from the inner surface of the coupling nut and facing in the second axial direction, the first and second stop shoulders aligned in axially facing relationship for abutting each other to prevent relative axial movement of the second shell and the coupling nut when the coupling nut is moved to decouple the first and second shells from each other.

* * * * *